United States Patent [19]

Immonen et al.

[11] Patent Number: 5,073,264

[45] Date of Patent: Dec. 17, 1991

[54] APPARATUS FOR TREATING FIBER SUSPENSION

[75] Inventors: Pasi H. Immonen; Raimo O. Kohonen, both of Savonlinna, Finland

[73] Assignee: A. Ahlstrom Corporation

[21] Appl. No.: 544,032

[22] Filed: Jun. 26, 1990

Related U.S. Application Data

[63] Continuation-in-part of Ser. No. 265,580, Nov. 1, 1988, abandoned.

[30] Foreign Application Priority Data

Nov. 5, 1987 [FI] Finland ..... 874887

[51] Int. Cl.[5] ..... B01D 33/23

[52] U.S. Cl. ..... 210/404; 68/181 R

[58] Field of Search ..... 8/156; 68/158, 181 R, 68/182; 210/402, 403, 404; 209/270, 271

[56] References Cited

U.S. PATENT DOCUMENTS

| | | | |
|---|---|---|---|
| 1,649,581 | 11/1927 | Genter et al. | 210/404 X |
| 2,027,652 | 1/1936 | Raisch | 210/404 X |
| 2,055,119 | 9/1936 | Clendening | 210/402 X |
| 2,115,211 | 4/1938 | Overbaugh | 210/402 X |
| 2,500,056 | 3/1950 | Barr | 210/402 X |
| 3,152,986 | 10/1964 | Bice et al. | 210/404 X |
| 3,504,802 | 4/1970 | Luthi | 210/404 |
| 4,333,836 | 6/1982 | Peroutka et al. | 210/404 |
| 4,695,381 | 9/1987 | Ragnegard | 210/404 X |

FOREIGN PATENT DOCUMENTS

| | | | |
|---|---|---|---|
| 796609 | 1/1936 | France | 210/404 |
| 1222515 | 10/1986 | Japan | 210/402 |

*Primary Examiner*—Philip R. Coe

*Attorney, Agent, or Firm*—Toren, McGeady & Associates

[57] ABSTRACT

An apparatus for treating pulp includes a pressure-proof outer casing for a suspension to be treated. A shaft is rotatably arranged in the outer casing and a number of disks are arranged substantially radially on the shaft within the casing. The disks are formed by a number of sectors each having two opposite filter surfaces for allowing liquid from the suspension to be drained therethrough and a liquid compartment between the filter surfaces for the drained liquid or filtrate, so that a substantially annular filter surface is formed. The liquid compartment is in communication with a liquid discharge member. The apparatus further includes members for dividing the annular filter surfaces into two or more portions. The members are stationary relative to the casing, so that the members are used for separating different treatment stages of fiber suspension from one another.

8 Claims, 5 Drawing Sheets

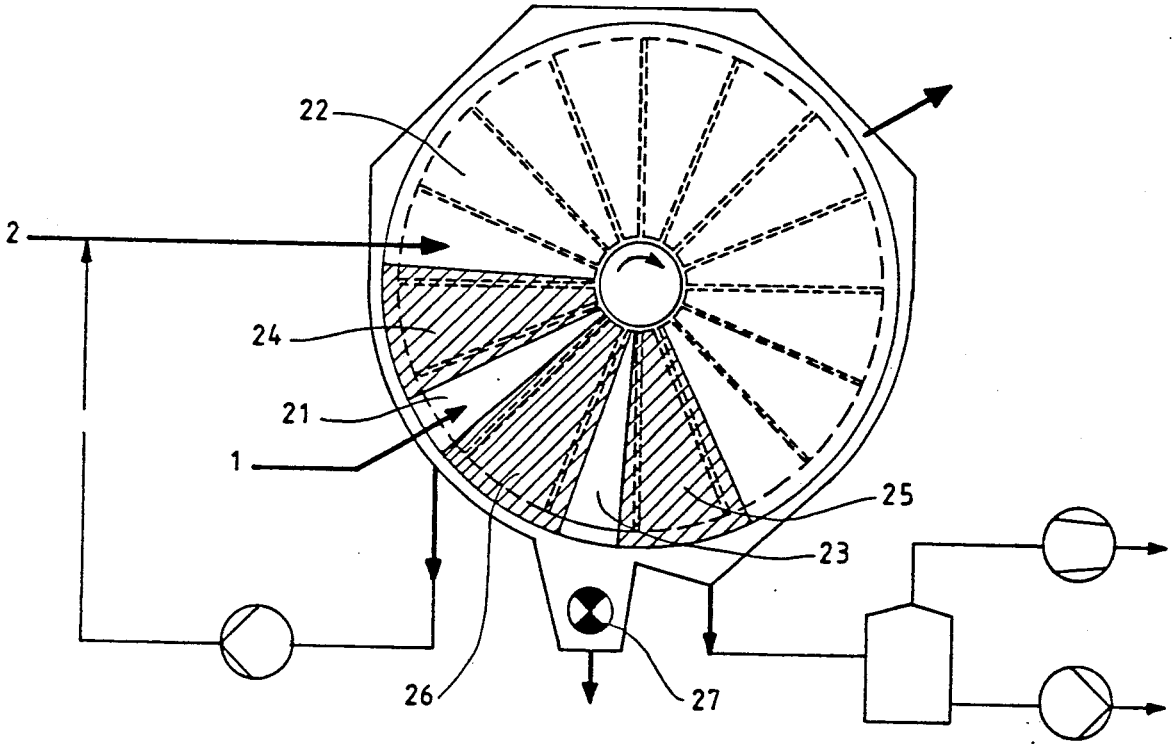

APPARATUS FOR TREATING FIBER SUSPENSION

This is a continuation-in-part of application Ser. No. 07/265,580, filed Nov. 1, 1988, and now abandoned.

The present invention relates to an apparatus for treating fiber suspension, in which the treatment is carried out under overpressurized conditions in an airless space. The invention is applied to a new type of disc filter treatment apparatus, which is developed to operate in a pressurized state.

There are, in principle, two different types of pulp treatment apparatuses known in the prior art. In most cases the most simple apparatus is a thickener, screen or washer operating under normal atmospheric pressure, whereby the apparatus does not have to be either pressure-proof or air-proof and whereby the transfer of liquid is carried out by means of reduced pressure. Thus the apparatus may be constructed considerably lighter, whereby the manufacturing costs remain relatively low and the acquisition of such an apparatus to the mills becomes economic. On the other hand due to the small pressure differences having an effect on the operation, in other words on the specific capacity, the apparatus has to be large so as to achieve a particular total capacity. In some cases it is also disadvantageous, particularly if air or like gas is included in the pulp to be treated. In order to at least partially eliminate said disadvantages pressurized pulp treatment apparatuses have been developed. Additionally, by using such apparatuses large filtrate tanks may be dispensed with.

Only drum-type filters, thickeners and screens of the known pulp treatment apparatuses have generally been pressurized. The advantages achieved by them have been, for example, the space saved at the mills, a specific capacity which is considerably higher than that of the unpressurized apparatuses and the airlessness of the treatment space of the pulp, whereby the quality of the pulp remains better. It may even be considered that the capacity of a whole mill could be increased if the old unpressurized treatment apparatuses were to be replaced by new type of apparatuses operating with larger pressure differences.

Since the drum-type pulp treatment apparatuses operating with overpressure have the same problems as the other drum-type apparatuses, for example, a long retention time of the so called cloudy water in the treatment means before its possible return back to the means to be cleared. In the drum-type apparatuses fiber suspension is normally fed to the outer circumference of the filter surface and the filtrate is discharged further on through the longitudinal channels of the cylinder, which are connected with each sector of the cylinder, and through valve members at the end of the cylinder both being inside the filter surface. If the cloudy liquid is desired to be returned back to the cylinder to be cleared, it has to be taken into consideration that the liquid has flowed long along channels which are several meters long to the end of the drum and from there further to the feed point. Thereby it is in practice impossible to divide the liquid flowing from the channel to cloudy and clear portions, in other words to a portion which is returned to the cylinder and a portion which is discharged from the means or fed into another stage, because the cloudy and the clear filtrate have probably already mixed with each other, whereby a lot of clear filtrate has to be returned back to the cylinder.

Because the retention time of the filtrate is by disc-type apparatuses only a fraction of that of a drum-type apparatus, the disc-type pulp treatment apparatuses have recently become popular. At the same time, however, a higher specific capacity is required from them as well as better adjustability and clearer filtrate, whereby the pressurization of the apparatuses has become the only possibility. West German Patent Application 3.210.200 and U.S. Pat. No. 4,695,381 have distinctively illustrated reasons for pressurizing disc filters. When using underpressure for the discharge of liquid from the fiber suspension, a 6 to 10 m high drop leg is required in an unpressurized disc filter to create a sufficient underpressure inside the filter sectors. Therefore, the filter has to be installed to said level to which the whole amount of the pulp to be treated has to be pumped. A second alternative for developing underpressure is naturally to use a vacuum pump, which however also adds costs. Additionally, the use of underpressure is restricted by the temperature of the fiber suspension to be treated, which may not rise over 80°-90° C., because due to the underpressure the liquid would start to boil on the underpressure side. Also the maximal pressure difference is 101 kPa which, as commonly known, cannot be exceeded.

Said prior publications illustrate a solution for eliminating or minimizing said problems, in which the pressure difference over the filter surfaces may be increased to the value of 300–400 kPa without any limitations as to the temperatures of the fiber suspensions to be treated. The apparatus comprises conventional filter disc units mounted on the shaft, which units are arranged inside a casing which may be pressurized. The pressure difference may be effected by a blower by which a desired overpressurized gas layer is generated in the upper part of a pressure vessel. The apparatus according to said U.S. patent includes also a control system by which the size of the gas layer is maintained as desired, in other words substantially the same as in conventional disc filters. Thus the only difference in the arrangement of said U.S. patent compared with the conventional disc filters is the pressure vessel operating as an outer casing of the apparatus and the overpressure created in the filter by a blower, by which arrangements a drop leg or a vacuum pump may be avoided and a higher pressure difference may be created over the filter surfaces, but there are now extra components, i.e. a blower, a pressure control system and a discharge and circulation system for air which has got into the filtrate, so altogether the apparatus has become even more complicated. Additionally, it has not been possible to eliminate from the apparatus the most well known defect in the disc filters, which is the considerably short length of the formation a pulp cake, about 180–200 degrees of the whole circumference of the filter disc, which considerably limits the specific capacity of the apparatus. On the other hand, this kind of guiding of pressurized air or like gas to communication with fiber suspension is not desirable in all cases, because the increase in the content of air in the suspension disturbs many processing stages by causing, for example, slime problems and making the pulp transfer by pumping more difficult.

It has been possible to eliminate or minimize the defects of the arrangements according to the above mentioned publications by the apparatus in accordance with the invention, in which the treatment of pulp is carried out in a closed pressurized apparatus, which has no gas space and no gas discharge and pressure control systems typical of the apparatus according to the above mentioned U.S. patent. Also the apparatus is characterized in that the filter surface in the apparatus can be utilized almost completely.

The apparatus in accordance with the present invention is characterized in that the annular surface formed by a sequence of sectors with filter surfaces is divided into two or more portions separated from each other by members which are stationary relative to the casing of the apparatus, which members separate different treatment stages of fiber suspension from each other.

The apparatus in accordance with the present invention is described below in greater detail, by way of example, with reference to the accompanying drawings, in which.

Figure 3A:
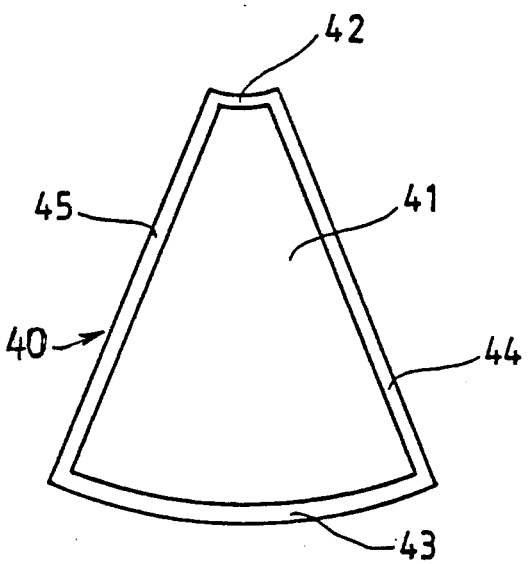
Figure 3B:
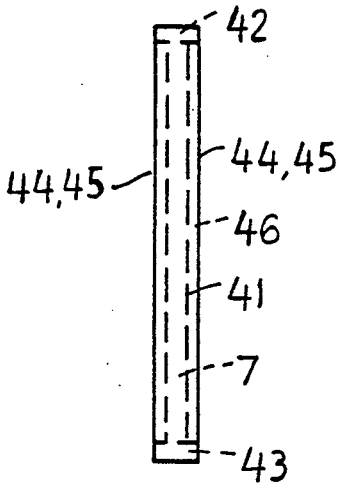
Figure 4:
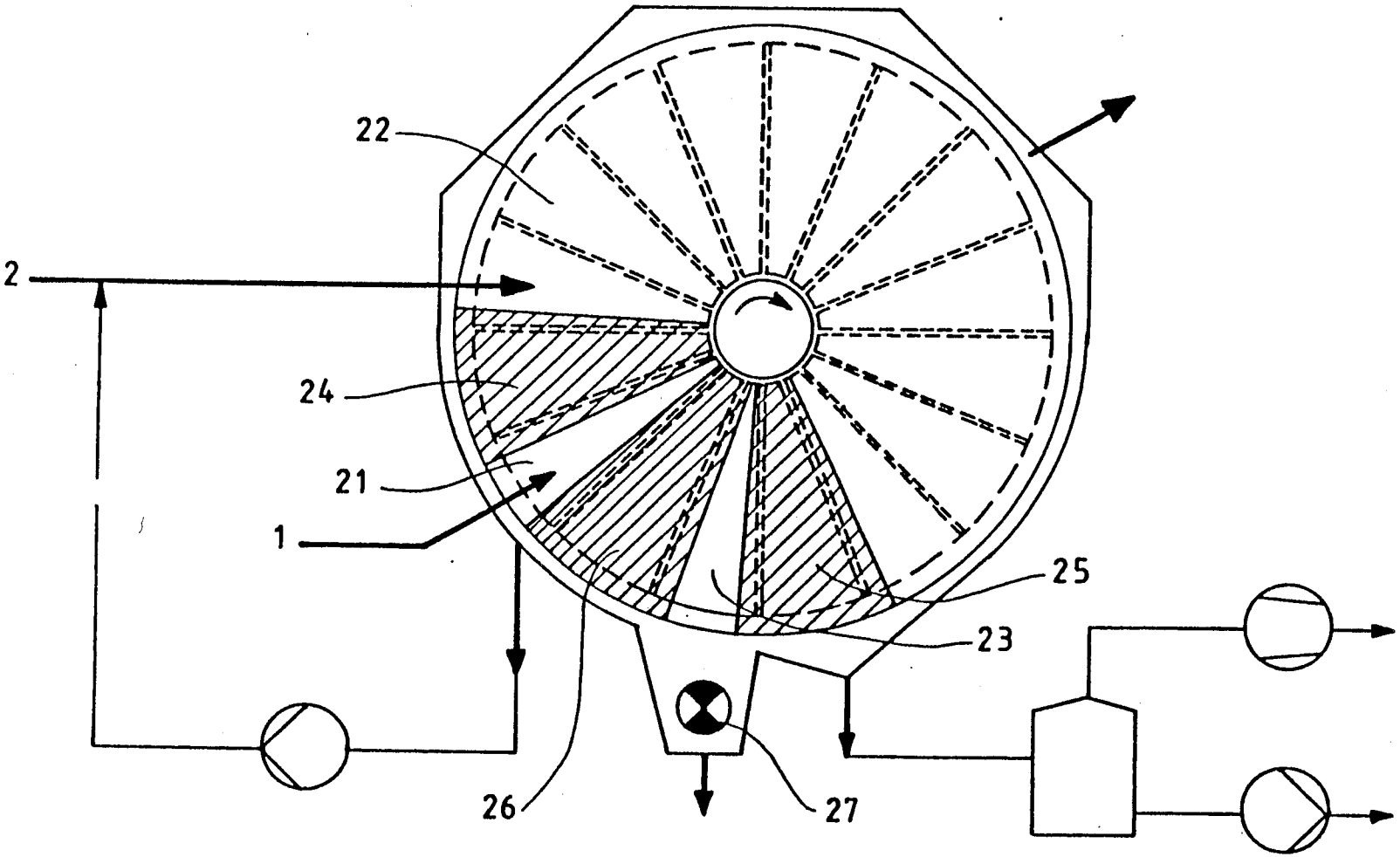
Figure 5:
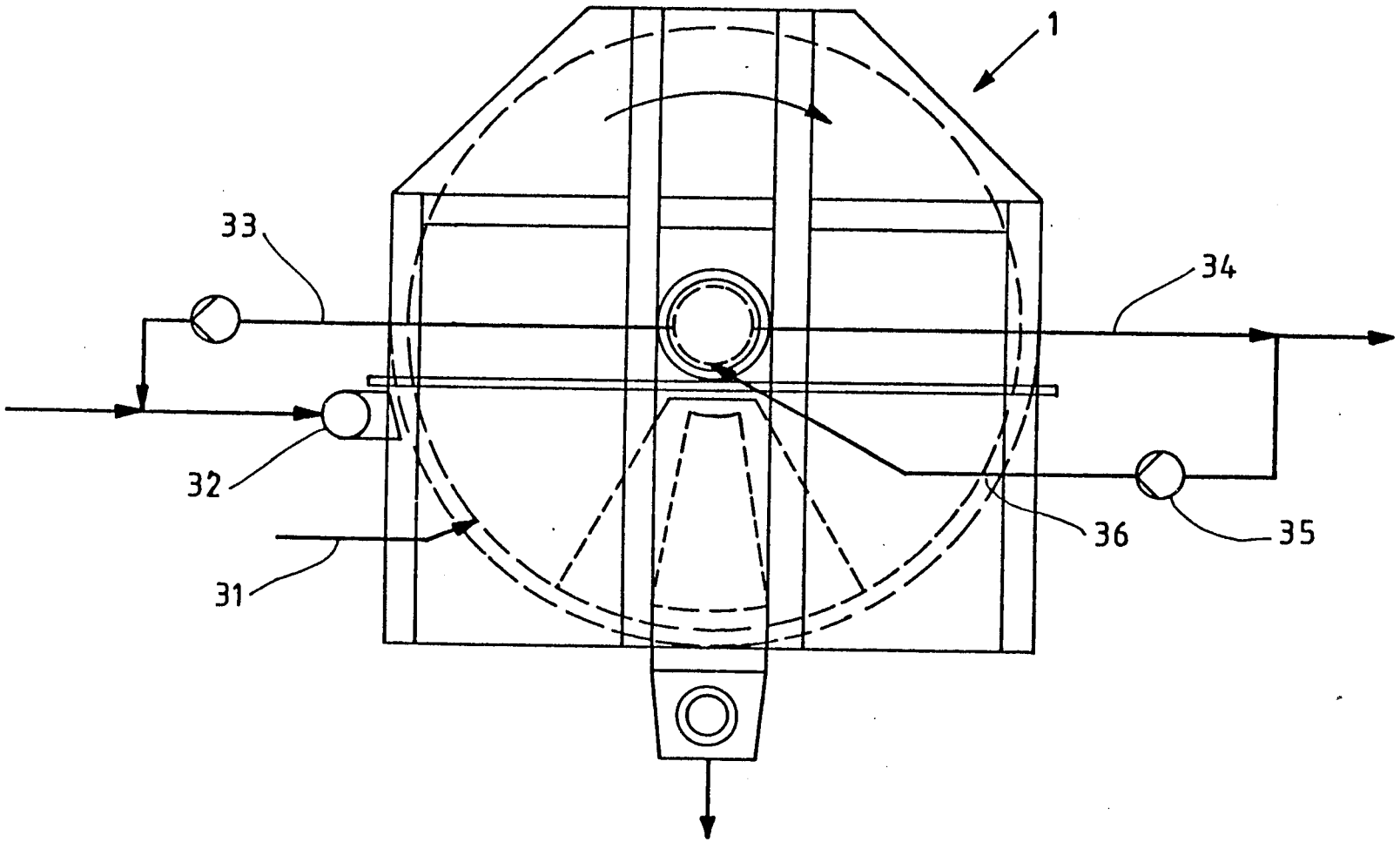
Figure 6:
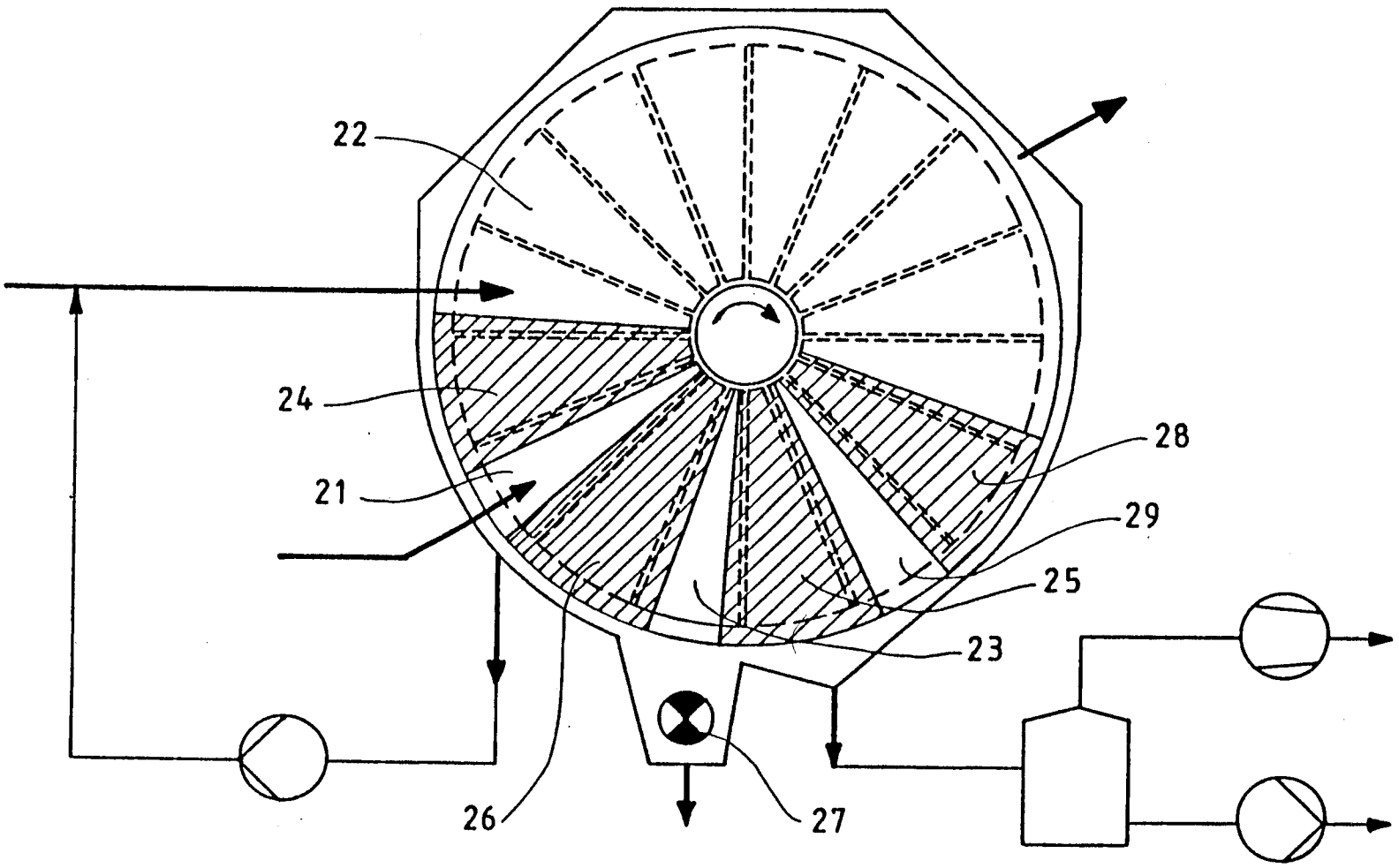

FIGS. 3*a* and 3*b* illustrate a preferred constructional alternative for the disc sector of an apparatus in accordance with the present invention;

FIG. 4 is a schematic illustration of a second embodiment of an apparatus in accordance with the present invention;

FIG. 5 is a schematic illustration of an alternative application of an embodiment of the apparatus in accordance with the present invention as shown in FIG. 4; and FIG. 6 is a schematic illustration of a further embodiment of an apparatus in accordance with the present invention.

Figure 1:
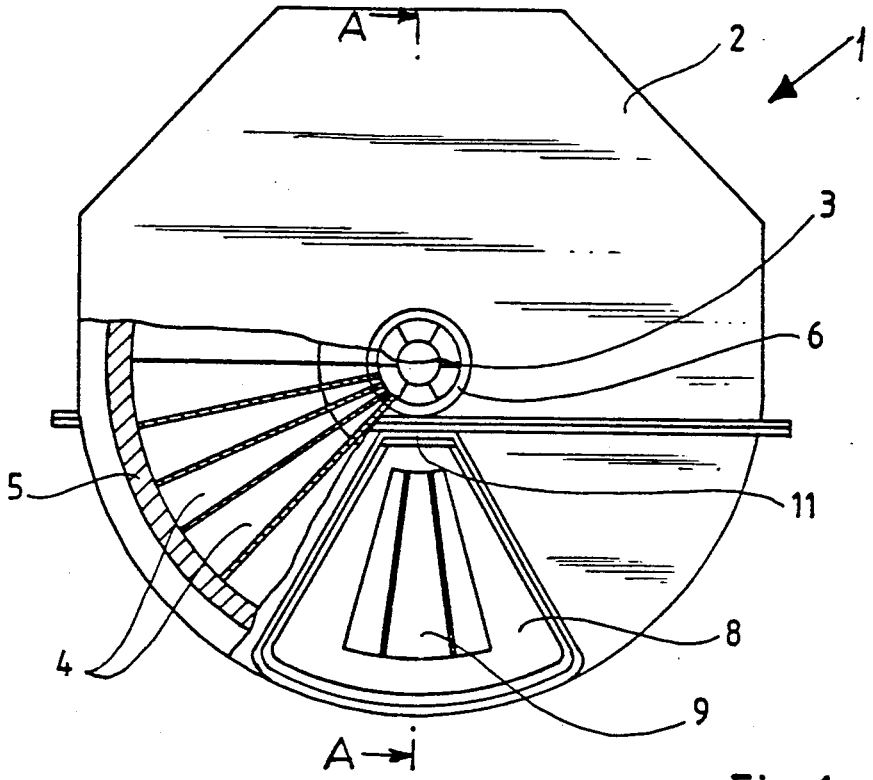
FIG. 1 is a schematic partly sectional view of an embodiment of an apparatus in accordance with the present invention.
Figure 2:
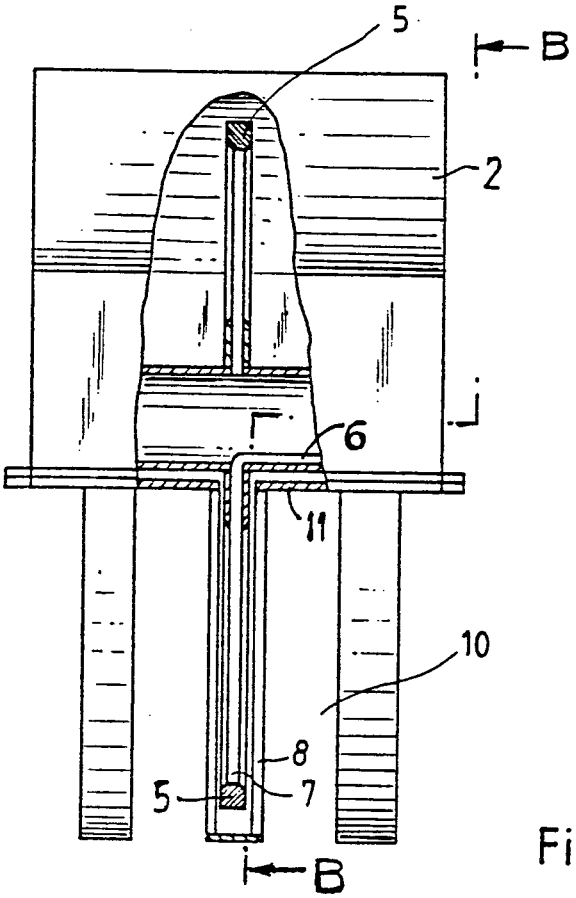
FIG. 2 is an axial partly sectional view of the apparatus of FIG. 1.

According to FIGS. 1 and 2, the pulp treatment apparatus 1 in accordance with the present invention mainly comprises discs 5, which are formed by a number of adjacent sectors 4 having two opposite filter surfaces and a liquid compartment therebetween, said discs being arranged radially on a shaft 3, all being located within a substantially pressure-proof casing 2. The sectors 4 are mounted on the shaft 3 in such a way that inside shaft 3 each sector has its own discharge/inlet duct 6 for liquid, which duct communicates with a liquid compartment 7 of each sector, which is defined in a known way by filter surfaces. According to the invention, the fiber suspension to be treated is fed in a pressurized manner into the interior of the casing 2 so that the space within the casing and between the discs is filled with suspension to be treated.

As can be understood the retention time of the filtrate flowing via the ducts from the pulp apparatus in accordance with the present invention is, for example, in thickening use very short. When guiding the filtrate liquid via the shaft out of the sectors and further out of the treatment apparatus, the liquid must, at its maximum, flow only along the length of the shaft to reach valve means located outside the apparatus, wherefrom the liquid is transferred for further treatment, for instance, to a thickening or file separation unit. The purpose of the valve means is to control the operation of the apparatus, i.e. to control the flow characteristics of the apparatus in such a way that a cloudy, fiber-containing filtrate received just in the beginning of the treatment operation does not mix with a clear filtrate received after a fiber mat of certain thickness is formed on the filtering surface. Thus there is no time for the cloudy and clear filtrate to be mixed with each other, and the amount of cloudy filtrate, which may possibly be returned to the apparatus, hardly differs from the true amount of the cloudy filtrate. In other words, there is a certain amount of cloudy filtrate that drains through the filtering surface to the filtrate/liquid compartment before the fiber mat has grown so thick that no fibers are able to reach the filtering surface and to penetrate therethrough into the filtrate compartment. After that the drained filtrate is clear. The cloudy filtrate should be returned back to the apparatus for recovering the fibers thereof or at least the fibers should be collected as well as one is able to. If the filtrate has only a little time to spend in the duct i.e. the duct is short, then the cloudy filtrate has little time to mix with the clear filtrate following it in the duct. The purpose of the valve means is to try to direct all the cloudy filtrate for instance back to the apparatus and the clear filtrate to some other location. The sooner the filtrate reaches the valve means the more accurate is the border between the cloudy and the clear filtrate. It is also possible to facilitate the flow of the liquid to the valve means by arranging the valve to the middle part of the apparatus, in other words to the middle portion of the shaft, whereby the above mentioned retention times are halved, as the distance from the outermost disc to the valve means is halved. The situation becomes even more advantageous when the filtrate liquid or the like is guided outwardly from the liquid compartment of the sector to the outer circumference of the sector, to which a valve means may be mounted, by which the run of the liquid is guided either back to some part of the apparatus, to the treatment zone or out of the apparatus. Respectively, it is possible to arrange corresponding separate valve means for each sector to the junction point of each sector and the shaft, which valve corresponding to the previous embodiment guides the flow of the liquid. In the two last mentioned cases the retention time of the liquid in the apparatus is minimized in such a way that the only factor affecting the retention time is the time passing in the flow of the liquid from the end of the sector which is opposite relative to the valve apparatus to the valve means.

When the apparatus in accordance with the present invention is used as a thickener, the pressure in the fiber suspension causes the liquid pressing through the filter surfaces of the sectors to the liquid compartment 7, through discharge duct 6 and finally out from the whole apparatus. Thereby the filter surface of the disc filter is almost completely efficiently used, i.e. almost all the filtering sectors may be used simultaneously for thickening the suspension. In other words the available surface of the disc for thickening is about 300°, whereby the pressure of the suspension causes the liquid to be pressed from the suspension through the filter surfaces into the liquid compartments of the sectors. Simultaneously the fiber mat starts forming on the filter surfaces and the thickness of said mat increases substantially all the time the mat is under the pressure of the suspension. The surface of the disc is almost completely available to be used for the liquid discharge from the fiber suspension on the filter surfaces of the disc with the only exception of the part or those sections in which the thickened pulp cake is at a particular moment being discharged.

FIGS. 1 and 2 disclose an embodiment for removing the pulp cake from the sectors. On both sides of each filter disc 5, sealing members are arranged at least at one location on the side face of disc 5 by which the pressure inside the casing is prevented from escaping to the loosening point of the pulp cake. The sealing member in the arrangement shown in FIG. 1 comprises a sector-like plate 8, in the middle of which there is an opening 9 which is larger than the filter surface of the disc sector, through which opening 9 the pulp cake is dropped off and transferred to be further treated. The plates 8 of two adjacent discs form a space 10 separated from the rest of treatment apparatus and opening (in the case of the figure) downwardly, through which space the pulp cake is discharged from the treatment apparatus. Thus the space inside casing 2 in the area of plates 8 has no fiber suspension at all. The size, or the circumferential breath, of the plates 8 depends on the sectors 4 of the disc 5 so that plate 8 seals the inner space of casing 2 in all angle positions of the disc to prevent the pressure at the suspension inside the apparatus from entering in or escaping to the discharge space 10. This space 10 is, of course, also sealed on the side of shaft 3 either by a curved or a straight plate 11.

FIGS. 3*a* and 3*b* shows a disc sector 40 of a preferred embodiment, which comprises a middle portion 41 with filter surfaces, the liquid compartment 7 and edge portions 42–45, which are raised relative to the middle portion, i.e., the filter surfaces, an outermost plane of which, relative to the wire surface, forms a sealing surface with the surface of the plate 8 on the disc side shown in the previous figures. Thus the filter surface 41 of each sector 40 in a way forms the bottom surface of compartment 46, in which compartment the pulp cake is formed when the apparatus operates as a thickener. The height of the edge portions 42–45 is advantageously defined in such a way that even in a maximum thickening process the thickness of the pulp cake does not exceed the height of the edge portions; in other word, the pulp cake never touches the surface of plate 8. This is required, because otherwise the friction between the pulp cake and plate 8 would rapidly raise the energy consumption of the apparatus.

As was mentioned above, the unbroken surface of plate 8 on both sides of opening 9 must be at least of the same size as sector 4 of disc 5 to prevent the pressure from escaping. When using high treatment pressure, it is advantageous to arrange a broader unbroken portion on the plate, whereby one sealing surface does not have to bear the stress alone. When high treatment pressures are used, it may be necessary to arrange more removal and discharge points for the pulp cake on the rim of the disc, because the formation speed of a pulp cake is high. Thus by arranging several discharge points it is possible to reduce the rotational speed of the discs to provide time for the formation of the pulp cake, whereby the overall production of a discharge point does not become any lower.

FIG. 4 shows a preferred embodiment of the apparatus in accordance with the present invention, which is mainly aimed to be used for the recovery of so called zero fiber, in other words, the fine dry substance which has been drawn in with the water removed from the web in a paper machine, containing short fibers and other fine particles, such as, filler material, or for like purpose. The surface of each rotating disc is divided into several operational zone, i.e., portions 21, 22, 23 by plates 24, 25 and 26 operating as sealing members. Long stock, i.e., pulp formed mainly of long fibers, is fed into the forming zone of the basic stock or portion 21. The long stock is allowed to thicken, whereby it forms the so called basic stock on the filter surfaces of the sectors for instance wire surfaces. In other words a fiber layer that operates as a filter medium for the actual zero fiber is formed on the filter surfaces. The pulp including zero fibers is fed in the apparatus in the beginning of the actual thickening zone or portion 22 as shown by arrow 2. The sealing member, in other words the plate 24 separates the basic stock forming zone or portion 21 from the actual thickening zone or portion 22, which (in the case of the figure) is about 250 degrees of the entire disc surface. The sealing member 25 separates the pulp cake discharging zone or portion 23 of the disc from thickening zone or portion 22. Portion 23 is used to remove the pulp cake from the filter surface and the cake is discharged further on by transfer devices 27, such as, a screw feeder.

Discharge zone or portion 23 is separated from the basic stock forming zone or portion 21 by means of sealing plate 26. As has become clear from the above, each sealing member must have an annular breadth of at least the same size as the sector of the disc so as to fulfil the minimum requirements of sealing. If one desires to improve the sealing, said breadth of the sealing surface should advantageously be a multiple of the breadth of the disc sector. It may also be seen in the figure that the sealing members may be separated relative to one another or, in another embodiment they may form a uniform plate surface which has openings for the infeed and for the discharge of the pulp cake.

FIG. 5 shows a scheme for the use of the apparatus of FIG. 4 for filtering zero water. Auxiliary pulp, i.e. long stock, is fed from conduit 31 to the basic stock forming zone or portion 21 of apparatus 1 of FIG. 4 for formation of the fiber mat which later on works as a filtering surface. It can be seen that as the filter discs rotate in the direction of the arrow, the pulp cakes has been just removed from the filter surfaces of the discs at the lowermost position of the filter sectors, whereby the filter surfaces are clean before the auxiliary pulp is fed to the portion 21. As explained earlier in connection with FIG. 4 the fiber mat is formed on the filter surfaces of the sectors before zero water is fed from conduit 32 for the actual thickening zone (22, FIG. 4), i.e. said zone 22 covers more than half of the entire apparatus or the entire disc filter area. It could even be said that the apparatus is filled with zero water except the area separated by sealing plates 24, 25 and 26 or in other words the area between the beginning of sealing plate 25 and the end of sealing plate 24, seen in the direction of rotation of the filter disc.

The initial filtrate 33 from the formation portion of the basic stock is guided through the infeed of zero water back to filtering apparatus 1. Though the basic stock contains longer fibers there are still shorter fibers that are being filtered through the filter surfaces during the formation of the basic stock so that in order to collect the shorter fibers the filtrate i.e. the cloudy filtrate has to be returned back to the apparatus together with the zero water to be treated. The clear filtrate received from the filter sectors at the actual thickening zone is gathered to conduit 34 and removed from the apparatus.

If the thickened pulp cake is removed by utilizing water showers, the filtrate from conduit 34, i.e. the clear filtrate, may be used for this purpose by taking part of it and by feeding it through pump 35 and conduit 36 back to the treatment apparatus. The removal of the pulp cake may be carried out from the inside of the sectors of the disc by guiding the water shower along the liquid discharge ducts of the shaft in the opposite direction relative to its conventional direction.

As for the removal of the pulp cake from filter surfaces in case the apparatus is used as a thickener, it is possible to use clear filtrate in loosening the cake, which filtrate is guided through the filtrate duct or the like of the shaft 3 back to the inside of the disc sectors, and thereafter the filtrate is pressed through the openings of the filter surface, so that it pushes the pulp cake loose from the filter surface and at the same time flushes i.e., cleans the filter medium. Naturally, it also is possible to blow gas along the same duct network so as to loosen the pulp cake.

It is also easy to arrange means for a liquid shower operating on a conventional principle to spray either water from a separate source or clear filtrate between the filter surface and the pulp cake. A third alternative principle is, of course, different types of scraper arrangements, which may be arranged to move into a sliding connection with the filter surface, i.e. to wipe the wire surface when it is at the discharge opening, and to rise higher when the edge protrusions of the sectors pass under the scrapers.

It is also possible to use the apparatus in accordance with the present invention for filtering zero fiber without a separate infeed of auxiliary pulp so that the auxiliary pulp is continuously fed together with the zero water, whereby zero fibers penetrate the wire surface at the beginning of the thickening stage. However, the additional pulp quickly forms basic stock on the wire surface, whereby the zero fibers no longer penetrate the filter medium. The basic stock is formed in reality so rapidly that even this kind of solution is possible, because the amount of cloudy filtrate does not increase excessively. The use of auxiliary pulp has been proved necessary in filtering zero water, because the filter medium will clog immediately at the beginning of the filtering stage without the pulp cake having time to be formed, if the filter medium is provided with so small perforations that zero fibers do not penetrate the medium.

FIG. 6 shows yet another embodiment of the apparatus in accordance with the present invention, in which an additional sealing element 28 and a pulp treatment element 29 have been added to the apparatus as compared to FIG. 4. The sealing element 28 is similar to previously described sealing elements, but the tone or portion 29 may be used, for example, for the finishing drying of the pulp cake by blowing drying gas into the compartment so that the gas replaces liquid in the pulp cake. Such method is used when a high dry substance content is desired and the penetration of gas into the pulp does not cause any harm.

In a corresponding way it is possible to add compartments separated by sealing members for different purposes, such as, for example, for washing the filter medium or if the apparatus is used as a pulp washer, it is possible to carry out all the stages required for the washing in one apparatus by arranging a sufficient amount of different zones, in other words pulp treatment elements. It is possible to use the apparatus as a multi-stage washer, for example in such a way that the fiber suspension to be treated is fed in the washing order to the first treatment compartment, to which filtrate from the second treatment compartment in the washing order is guided as a washing liquid. The suspension is then transferred by the rotation of the treatment disc to the second treatment stage, to which filtrate of the third treatment stage is guided as a washing liquid. The process continues in such way until the fiber suspension reaches a sufficient level of cleanliness, after which it is discharged from the apparatus.

It is, of course, possible to arrange the washing also in such a way that the filtrate utilized to operate as washing liquid in each washing stage is not the filtrate of the immediately following stage, but that of some other following stage, whereby the difference in level of cleanliness between the washing liquid and the suspension to be treated is greater and the washing effect of the liquid is somewhat more efficient.

As is seen from the above description, a new many-sided pulp treatment apparatus is developed which eliminates or minimizes the drawbacks of the apparatuses of the prior art techniques, and the above description shows only a few embodiments of the apparatus which are not intended to restrict the scope of invention from that given in the accompanying claims.

We claim:

1. An apparatus for treating pulp, the apparatus comprising a pressure-proof outer casing for containing a suspension to be treated; a shaft having an axis arranged rotatably in the outer casing; and a plurality of discs attached substantially radially to said shaft within said casing; each of said discs being formed by a plurality of sectors, each sector having two opposite, axially spaced filter surfaces extending substantially perpendicularly to said shaft for allowing liquid from said suspension to be drained therethrough, said filter surfaces defining a liquid compartment therebetween for said liquid, said opposite filter surfaces of the sectors of said disc each forming an essentially annular filter surface on opposite sides of each disc; said liquid compartment being in communication with a liquid discharge means; the apparatus further comprising members for dividing said annular filter surfaces into at least two portions, said members being stationary relative to the casing, said members being provided for separating different treatment stages of fiber suspension from one another.

2. The apparatus as recited in claim 1, wherein said members are sealing members, the members separating at least one sector at a time from other sectors, whereby the different treatment stages are sealed such that the suspensions in said treatments stages are prevented from mixing together.

3. The apparatus as recited in claim 2, said sectors further comprising edge portions which circumferentially surround said filter surfaces.

4. The apparatus as recited in claim 3, wherein the edge portions extend above the filter surface and form a trough-like compartment with said filter surface, the treatment of pulp being carried out or pulp cake being formed in said trough-like compartment.

5. The apparatus as recited in claim 4, said edge portions having outer plane surfaces parallel to the filter surface, a seal being formed by said outer plane surface together with surfaces of said separating members facing said sectors, the seal separating the treatment stages from each other.

6. The apparatus as recited in claim 1, the liquid discharge means comprising transfer ducts for filtrate, said ducts being in connection with the shaft for removing the filtrate from the apparatus.

7. The apparatus as recited in claim 1, the liquid discharge means comprising a duct arranged on a radially outer edge of each sector.

8. The apparatus as recited in claim 1, the liquid discharge means comprising ducts arranged in communication with said shaft.

* * * * *